US012104882B2

(12) United States Patent
Ye et al.

(10) Patent No.: US 12,104,882 B2
(45) Date of Patent: Oct. 1, 2024

(54) SKIN-CORE STRUCTURE FIBERS WITH BOTH INFRARED AND RADAR STEALTH, PREPARATION METHOD THEREFOR, AND USE THEREOF

(71) Applicant: NANTONG UNIVERSITY, Jiangsu (CN)

(72) Inventors: Wei Ye, Jiangsu (CN); Xing Zhang, Jiangsu (CN); Qilong Sun, Jiangsu (CN); Xiaoyun Long, Jiangsu (CN); Qiang Gao, Jiangsu (CN); Tao Ji, Jiangsu (CN)

(73) Assignee: NANTONG UNIVERSITY, Jiangsu (CN)

( * ) Notice: Subject to any disclaimer, the term of this patent is extended or adjusted under 35 U.S.C. 154(b) by 0 days.

(21) Appl. No.: 18/287,189

(22) PCT Filed: May 10, 2022

(86) PCT No.: PCT/CN2022/091935

§ 371 (c)(1),
(2) Date: Oct. 17, 2023

(87) PCT Pub. No.: WO2022/262479

PCT Pub. Date: Dec. 22, 2022

(65) Prior Publication Data

US 2024/0175661 A1 May 30, 2024

(30) Foreign Application Priority Data

Jun. 15, 2021 (CN) ..... 202110660239.1

(51) Int. Cl.

| | |
|---|---|
| ***D01D 1/02*** | (2006.01) |
| ***D01D 1/04*** | (2006.01) |
| ***D01D 5/04*** | (2006.01) |
| ***D01D 5/06*** | (2006.01) |
| ***D01D 5/34*** | (2006.01) |
| ***D01F 1/10*** | (2006.01) |
| ***D01F 8/06*** | (2006.01) |
| ***D01F 8/08*** | (2006.01) |
| ***D01F 8/10*** | (2006.01) |
| ***D04H 1/4382*** | (2012.01) |
| ***D04H 1/46*** | (2012.01) |
| ***D04H 3/105*** | (2012.01) |
| ***F41H 3/02*** | (2006.01) |

(52) U.S. Cl.

CPC ..... *F41H 3/02* (2013.01); *D01D 1/04* (2013.01); *D01D 5/34* (2013.01); *D01F 1/106* (2013.01); *D01F 8/06* (2013.01); *D01F 8/08* (2013.01); *D04H 1/43828* (2020.05); *D04H 1/46* (2013.01); *D10B 2321/02* (2013.01); *D10B 2321/10* (2013.01); *D10B 2401/00* (2013.01); *D10B 2507/00* (2013.01)

(58) Field of Classification Search

CPC ..... D01D 1/02; D01D 5/04; D01D 5/06; D01D 5/34; D01F 1/106; D01F 8/06; D01F 8/08; D01F 8/10; D04H 3/105

USPC .... 264/172.11, 172.15, 172.16, 172.18, 211, 264/103; 28/107

See application file for complete search history.

(56) References Cited

U.S. PATENT DOCUMENTS

| | | | | |
|---|---|---|---|---|
| 2007/0089276 | A1* | 4/2007 | Dugan | D01F 8/06 19/144 |
| 2010/0247909 | A1* | 9/2010 | Lee | D01F 9/14 423/447.2 |

FOREIGN PATENT DOCUMENTS

| | | |
|---|---|---|
| CN | 1696360 | 11/2005 |
| CN | 101205640 | 6/2008 |
| CN | 106801266 | 6/2017 |
| CN | 108374238 | 8/2018 |
| CN | 108570766 | 9/2018 |
| CN | 109778344 | 5/2019 |
| CN | 110129916 | 8/2019 |
| CN | 112928389 | 6/2021 |
| CN | 113249821 | 8/2021 |
| CN | 113789609 | 12/2021 |
| JP | S5378323 | 7/1978 |

OTHER PUBLICATIONS

Translation of CN 108374238 A (published on Aug. 7, 2018).*

"International Search Report (Form PCT/ISA/210) of PCT/CN2022/091935", mailed on Jul. 1, 2022, with English translation thereof, pp. 1-6.

"Written Opinion of the International Searching Authority (Form PCT/ISA/237) of PCT/CN2022/091935", mailed on Jul. 1, 2022, pp. 1-5.

* cited by examiner

*Primary Examiner* — Leo B Tentoni
(74) *Attorney, Agent, or Firm* — JCIPRNET

(57) ABSTRACT

Skin-core structure fibers with both infrared and radar stealth, a preparation method therefor, and the use thereof are provided. The fibers are as follows: a core material of the skin-core structure fibers comprises the following raw materials in parts by weight: 10 parts of paraffin; 0.7-1.5 parts of an electromagnetic wave absorbent; and 1 part of a high-molecular polymer, wherein the electromagnetic wave absorbent is one or more of ferroferric oxide-intercalated graphene oxide, nano ferroferric oxide and carbon black, and wherein the skin-core structure fiber is obtained by spinning the core material with a skin-layer material.

7 Claims, 4 Drawing Sheets

SKIN-CORE STRUCTURE FIBERS WITH BOTH INFRARED AND RADAR STEALTH, PREPARATION METHOD THEREFOR, AND USE THEREOF

CROSS-REFERENCE TO RELATED APPLICATION

This application is a 371 of international application of PCT application serial no. PCT/CN2022/091935, filed on May 10, 2022, which claims the priority benefit of Chinese patent application NO. 202110660239.1, filed on Jun. 15, 2021 and entitled "SKIN-CORE STRUCTURE FIBERS WITH BOTH INFRARED AND RADAR STEALTH, PREPARATION METHOD THEREFOR, AND USE THEREOF." The entirety of each of the above mentioned patent applications is hereby incorporated by reference in its entirety.

TECHNICAL FIELD

The present disclosure belongs to the technical field of material engineering, and especially relates to skin-core structure fibers with both infrared and radar stealth, a preparation method thereof, and a use thereof.

BACKGROUND

In many military operations, detection technologies such as radar, infrared are commonly used to improve the capabilities for target recognition, such that a single stealth technology can not satisfy the practical requirements. Therefore, the developments on the multifunctional stealth materials have important market prospects. At present, the multifunctional composite materials equipped with the stealth functions such as the visible light, the infrared, and the radar are the development trends and the key development objectives around various countries. With the developments on the nanotechnologies and the new spinning technologies, the multifunctional stealth materials that are lightweight, easy to mold and in fiber shape have excellent application prospects. However, stealth protections are mainly used through coating or multi-layer structures currently, with a single formation.

The electromagnetic wave absorbing materials such as the nano ferroferric oxide, the carbon black, and the ferroferric oxide-intercalated graphene oxide are the research hotspots currently. Since different materials have the problems of the mutual interferences between the electromagnetic wave absorption and the thermal infrared stealth, certain difficulties exist in solving the problems of combining the electromagnetic wave and the infrared stealth functions. Paraffin is a phase change material with low cost, good wave permeability, large latent heat of the phase change, and a wide range of the phase change temperature. And paraffin has good compatibility with the ferroferric oxide, the carbon black, the graphene and so on, which is used as a binder in dielectric constant tests. Therefore, infrared and radar stealth materials with excellent performances can be prepared through appropriate processes, while relevant technologies are obviously lacked in existing technologies.

SUMMARY

The exemplary embodiments of the present disclosure provide skin-core structure fibers with both infrared and radar stealth, a preparation method thereof, and a use thereof. The produced infrared stealth and radar stealth materials in fiber shape can be prepared into the products such as fabrics and non-woven fabrics, and the products are convenient to use and have a wide range of application prospects.

In one aspect, the present disclosure provides the skin-core structure fibers with both infrared and radar stealth. In the fibers, a core material of the skin-core structure fibers includes the following raw materials in parts by weight: 10 parts of paraffin. 0.7 parts to 1.5 parts of an electromagnetic wave absorbent, and 1 part of a high-molecular polymer. The electromagnetic wave absorbent is one or more of a ferroferric oxide-intercalated graphene oxide, a nano ferroferric oxide and a carbon black.

The skin-core structure fibers are obtained by means of spinning the core material with a skin-layer material.

In one embodiment, the high-molecular polymer is one or more of a polyethylene, a polypropylene and an ethylene-vinyl acetate.

In another aspect, the present disclosure provides a method for preparing the skin-core structure fibers with both infrared and radar stealth. The method includes the following steps.

In Step 1), the paraffin is melted, into which the electromagnetic wave absorbent is added, to stirred evenly and thoroughly to obtain molten solution S1.

In Step 2), the high-molecular polymer is melted, and subsequently the high-molecular polymer is added into the molten solution S1, stirred thoroughly and evenly, and then dried to obtain a core material S2.

In Step 3), the polyacrylonitrile is dissolved into a N. N-dimethylacetamide, stirred evenly, and stood still to obtain an external phase spinning solution.

In Step 4), the core material S2 is taken as the core material and the external phase spinning solution is taken as a skin material for solution spinning, and to obtain the skin-core structure fibers with both infrared and radar stealth.

In one embodiment, a melting temperature of the paraffin in Step 1) is 70° C.

In one embodiment, a melting temperature of the high-molecular polymer in Step 2) ranges from 130° C. to 140° C.

In one embodiment, a standing time in Step 3) is 10 hours.

In one embodiment, a mass concentration of the polyacrylonitrile in the external phase spinning solution in Step 3) ranges from 20% to 25%.

In one embodiment, a nozzle temperature of the core material in Step 4) is controlled from 140° C. to 150° C.

The present disclosure further seeks to protect a use of the skin-core structure fibers with both infrared and radar stealth in a preparation of an infrared stealth material and a radar stealth material.

In one embodiment, the infrared stealth material and the radar stealth material are needled felt.

The present disclosure has the following beneficial effects.

1. In one aspect, the present disclosure uses the nano ferroferric oxide, the carbon black, and the ferroferric oxide-intercalated graphene oxide, which are all the latest efficient electromagnetic wave absorbing materials. And the special skin core structures are used to increase the load capacities of the paraffin and the electromagnetic wave absorbing materials, ultimately exhibiting to be a fibrous form, which facilitates molding.

2. The present disclosure utilizes skin core spinning technology to prepare the phase change materials and the electromagnetic wave absorbing materials into the fiber materials with the skin core structure, which solves the disadvantages that the stealth materials are merely equipped with a single infrared stealth or a single radar stealth. And the methods for molding the fiber materials are various and convenient to use. The dielectric loss carbon materials and the magnetic loss ferrite materials in nano structures are widely used in various fields of the electromagnetic wave absorption, which especially have good performance of the electromagnetic wave loss in the range of 8 GHz to 18 GHz. In the infrared stealth materials, phase change materials have excellent advantages, and the paraffin with a melting point that ranges from 47° C. to 64° C. is a far infrared stealth material with low cost and good protective effect.
3. The present disclosure combines the nano electromagnetic wave absorbing materials with the paraffin phase change materials to prepare the multifunctional stealth materials in fiber shape with the infrared stealth and the radar stealth, which have a good electromagnetic wave absorption performance in the far infrared absorption and the radar band that ranges from 8 GHz to 18 GHz in comparison with the existing single function stealth materials, thereby eliminating the disadvantages of the single function products in the current market.

DETAILED DESCRIPTION OF THE EMBODIMENTS

The present disclosure will be detailedly described below in conjunction with the accompanying drawings and the specific embodiments.

In one embodiment, provided is skin-core structure fibers with both infrared and radar stealth. A core material of the skin-core structure fibers includes the following raw materials in parts by weight: 10 parts of paraffin. 0.7 parts to 1.5 parts of an electromagnetic wave absorbent, and 1 part of a high-molecular polymer. The electromagnetic wave absorbent is one or more of a ferroferric oxide-intercalated graphene oxide, a nano ferroferric oxide and a carbon black.

The skin-core structure fibers are obtained by means of spinning the core material with a skin-layer material.

The above-mentioned electromagnetic wave absorbent is one or more of a ferroferric oxide-intercalated graphene oxide, a nano ferroferric oxide and a carbon black.

The above-mentioned high-molecular polymer is one or more of a polyethylene, a polypropylene and an ethylene-vinyl acetate.

Provided is a method for preparing the skin-core structure fibers with both infrared and radar stealth. The method includes the following steps.

In Step 1). 1000 g paraffin are melted at 70° C. and 50 g ferroferric oxide-intercalated graphene oxide and 20 g carbon black are added into the melted paraffin, stirred evenly and thoroughly to prepare the solution S1 of the infrared and electromagnetic wave absorbing material.

In Step 2). 50 g polyethylene. 30 g polypropylene and 20 g ethylene-vinyl acetate are melted at 140° C., and subsequently are added into the solution S1, stirred thoroughly and evenly, and then the molten solution S1 is dried to prepare the core material S2.

In Step 3), the polyacrylonitrile is dissolved into a N. N-dimethylacetamide, stirred evenly and stood still for 10 hours to prepare the external phase spinning solution with a mass concentration of 25% polyacrylonitrile (polyacrylonitrile solution).

Figure 1:
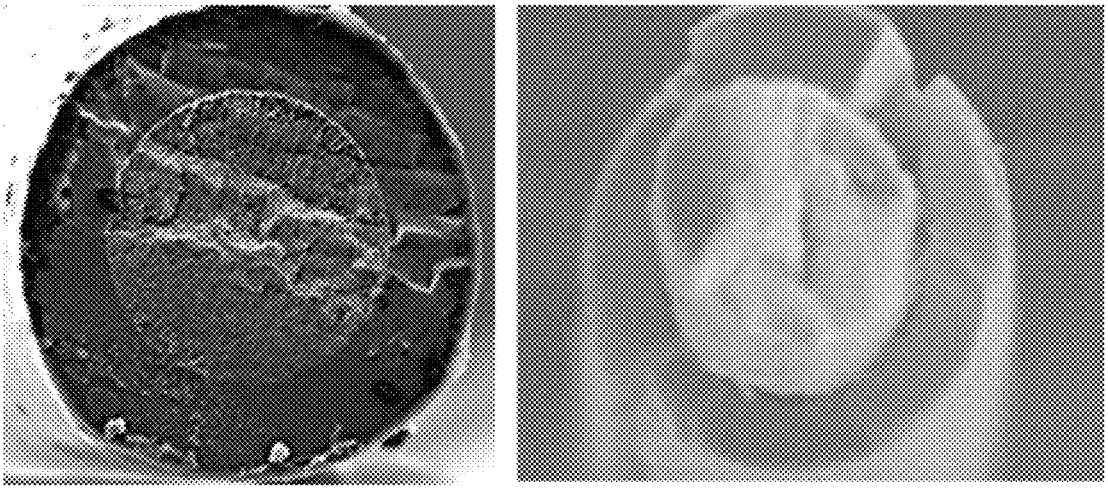
FIG. 1 illustrates an SEM diagram of fiber materials prepared in one embodiment of the present disclosure.

In Step 4), the core material S2 is taken as the core material (a nozzle temperature of the core material is controlled at 150°) C. and the polyacrylonitrile solution is taken as a skin material for the solution spinning, to prepare the skin-core structure fibers. As illustrated in FIG. 1, under a scanning electron microscopy, it can be obviously seen that a skin core structure is formed, and the inner layer is the core layer, and the outer layer is wrapped around the core layer.

Figure 2:
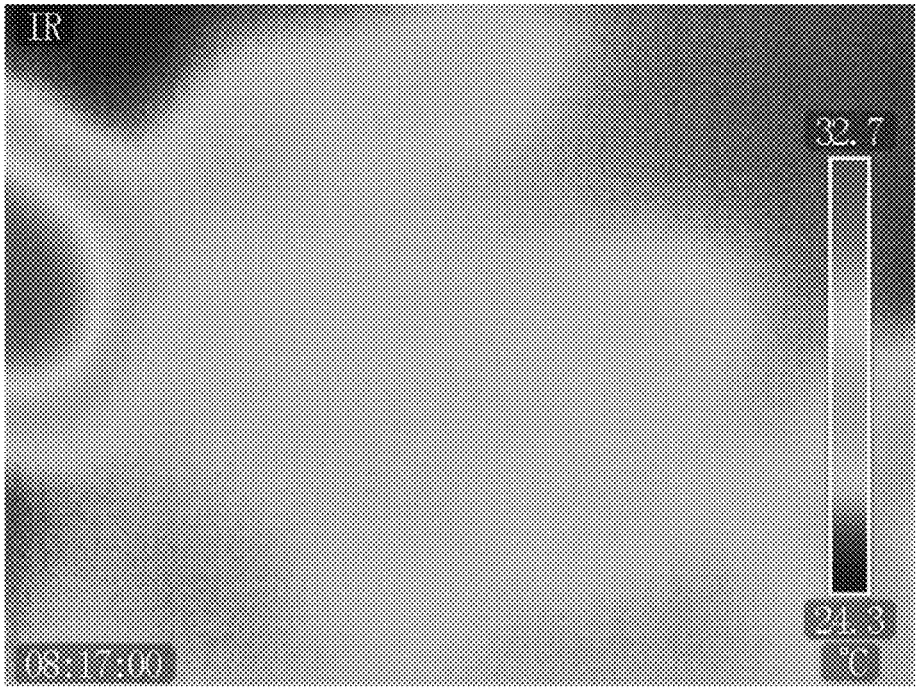
FIG. 2 illustrates a thermal infrared imaging placed on a human hand of a fiber material needled felt made in one embodiment of the present disclosure.
Figure 3:
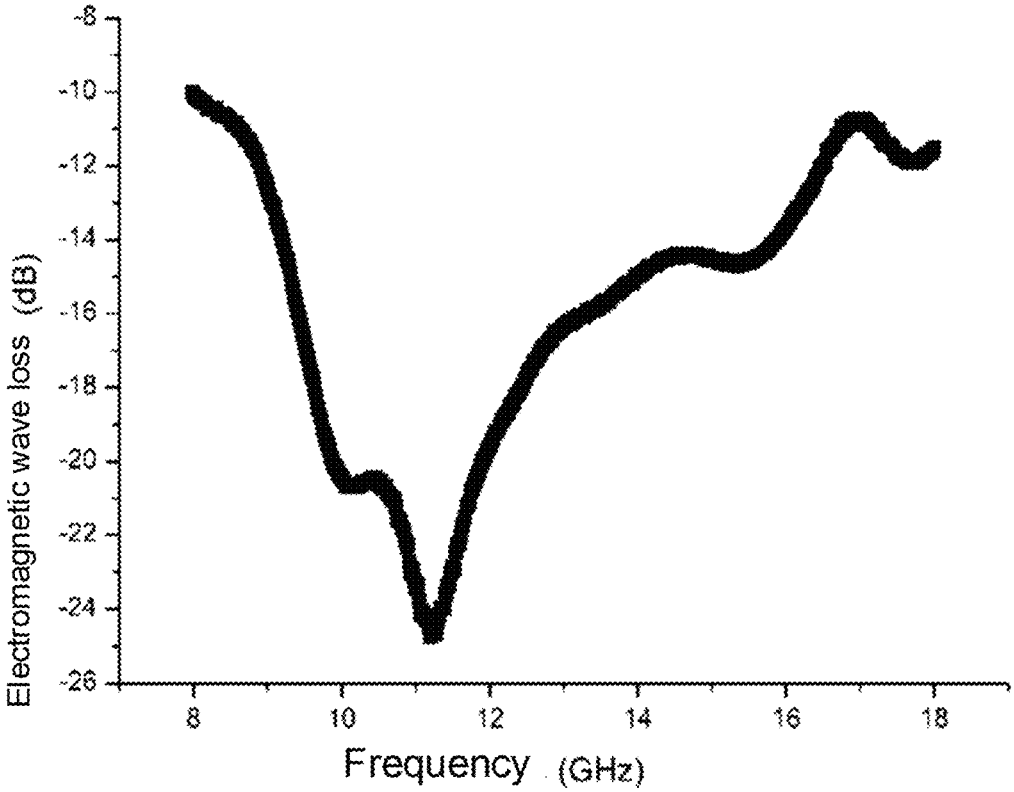
FIG. 3 illustrates a diagram of an electromagnetic wave absorption performance of the fiber material needled felt (with a thickness of 10 mm) prepared in one embodiment of the present disclosure.

After the tests, the fiber materials prepared in this embodiment, whose phase transition enthalpy is up to 95.1 J/g, and is equipped with ultra-low infrared transmittance in the infrared band ranges from 3 μm to 15 μm. The fibers are needled into the felt and the felt is placed on the back of the human hand, and the thermal imaging detection image of the human hand is as illustrated in FIG. 2. The felt with a thickness of 10 mm can reach the absorption efficiency below −10 dB in the range from 8 GHz to 18 GHz, and the electromagnetic wave absorption performance is as illustrated in FIG. 3.

In one embodiment, provided is a method for preparing the skin-core structure fibers with both infrared and radar stealth. The method includes the following steps.

In Step 1). 1000 g paraffin are melted at 70° C. and 100 g nano ferroferric oxide and 50 g carbon black are added into the melted paraffin, stirred evenly and thoroughly to prepare the solution S1 of the infrared and electromagnetic wave absorbing material.

In Step 2). 50 g polyethylene. 30 g polypropylene and 20 g ethylene-vinyl acetate are melted at 130° C., and subsequently are added into the molten solution S1, stirred thoroughly and evenly, and then the molten solution S1 is dried to prepare the core material S2.

In Step 3), the polyacrylonitrile is dissolved into a N. N-dimethylacetamide, stirred evenly and stood still for 10 hours to prepare the external phase spinning solution with a mass concentration of 25% polyacrylonitrile (polyacrylonitrile solution).

In Step 4), the core material S2 is taken as the core material (a nozzle temperature of the core material is controlled at 140° C.) and the polyacrylonitrile solution is taken as a skin material for the solution spinning, to prepare the skin-core structure fibers.

Figure 4:
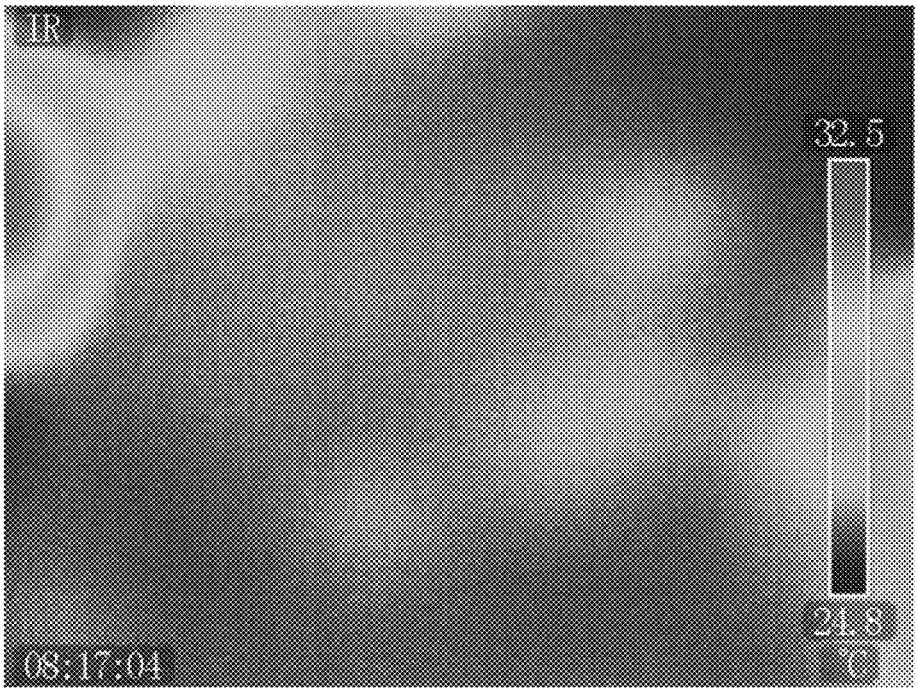
FIG. 4 illustrates a thermal infrared imaging placed on the human hand of the fiber material needled felt made in one embodiment of the present disclosure.
Figure 5:
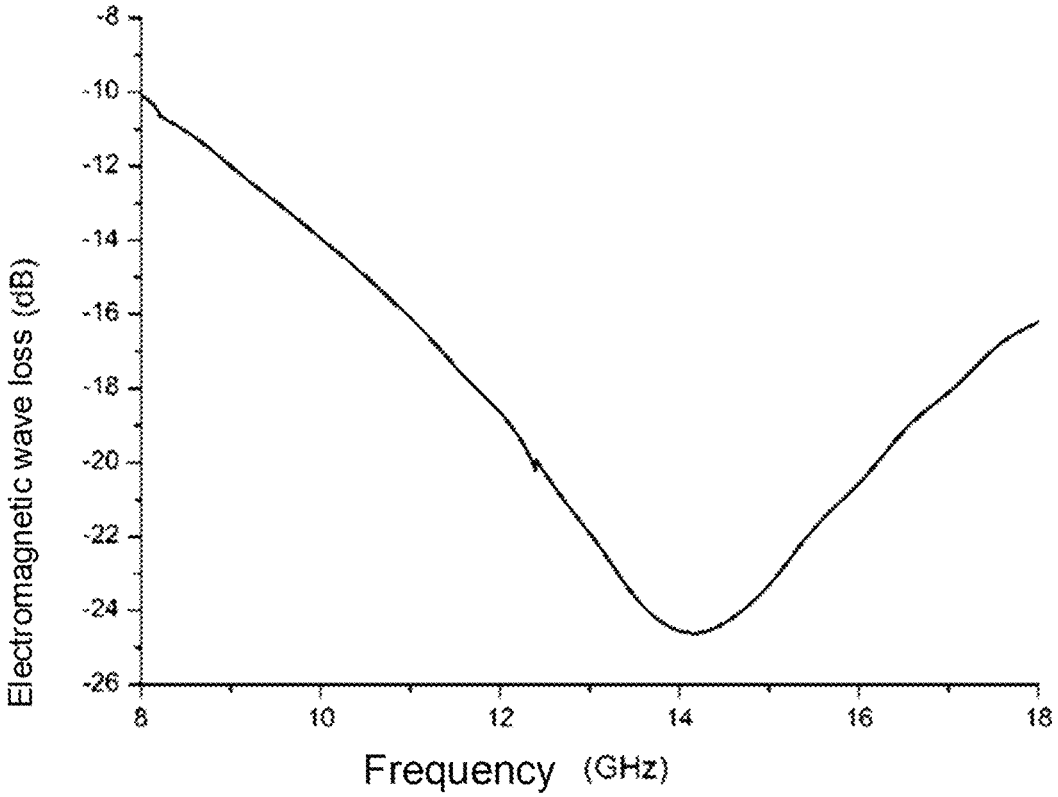
FIG. 5 illustrates a diagram of the electromagnetic wave absorption performance of the fiber material needled felt (with a thickness of 10 mm) prepared in one embodiment of the present disclosure.

After the tests, the fiber materials prepared in this embodiment, whose phase transition enthalpy is up to 100.1 J/g, and is equipped with ultra-low infrared transmittance in the infrared band ranges from 3 μm to 15 μm. The fibers are needled into the felt and the felt is placed on the back of the human hand, and the thermal imaging detection image of the human hand is as illustrated in FIG. 4. The felt with a thickness of 10 mm can reach the absorption efficiency below −10 dB in the range from 8 GHz to 18 GHz, and the electromagnetic wave absorption performance is as illustrated in FIG. 5.

In one embodiment, provided is a method for preparing the skin-core structure fibers with both infrared and radar stealth. The method includes the following steps.

In Step 1). 1000 g paraffin are melted at 70° C. and 70 g ferroferric oxide-intercalated graphene oxide and 30 g carbon black are added into the melted paraffin, stirred evenly and thoroughly to prepare the solution S1 of the infrared and electromagnetic wave absorbing material.

In Step 2), 50 g polyethylene, 30 g polypropylene and 20 g ethylene-vinyl acetate are melted at 130° C., and subsequently are added into the molten solution S1, stirred thoroughly and evenly, and then the molten solution S1 is dried to prepare the core material S2.

In Step 3), the polyacrylonitrile is dissolved into a N, N-dimethylacetamide, stirred evenly and stood still for 10 hours to prepare the external phase spinning solution with a mass concentration of 25% polyacrylonitrile (polyacrylonitrile solution).

In Step 4), the core material S2 is taken as the core material (a nozzle temperature of the core material is controlled at 140° C.) and the polyacrylonitrile solution is taken as a skin material for the solution spinning, to prepare the skin-core structure fibers.

Figure 6:
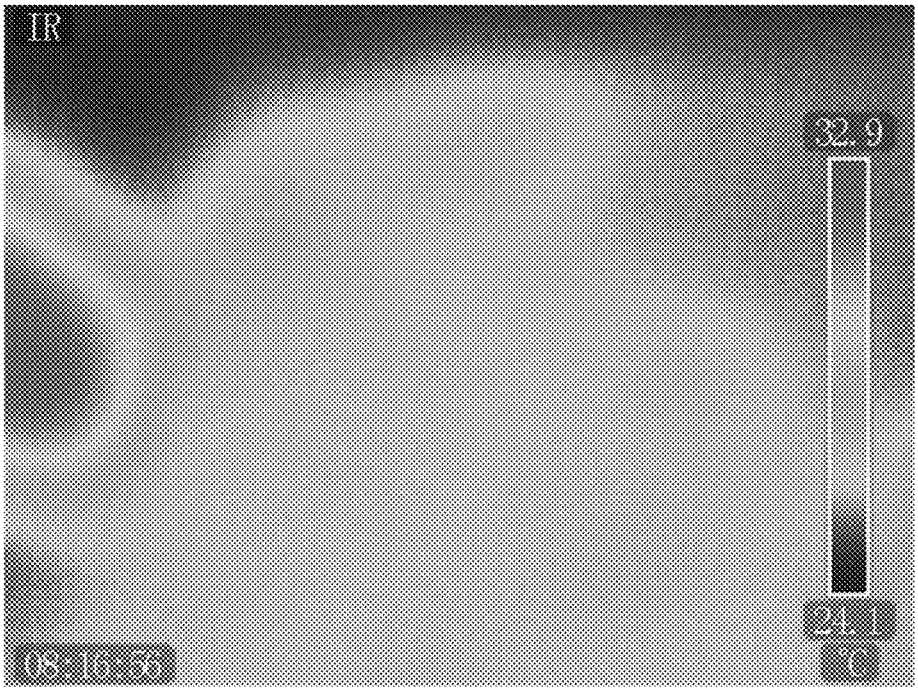
FIG. 6 illustrates a thermal infrared imaging placed on the human hand of the fiber material needled felt made in one embodiment of the present disclosure.
Figure 7:
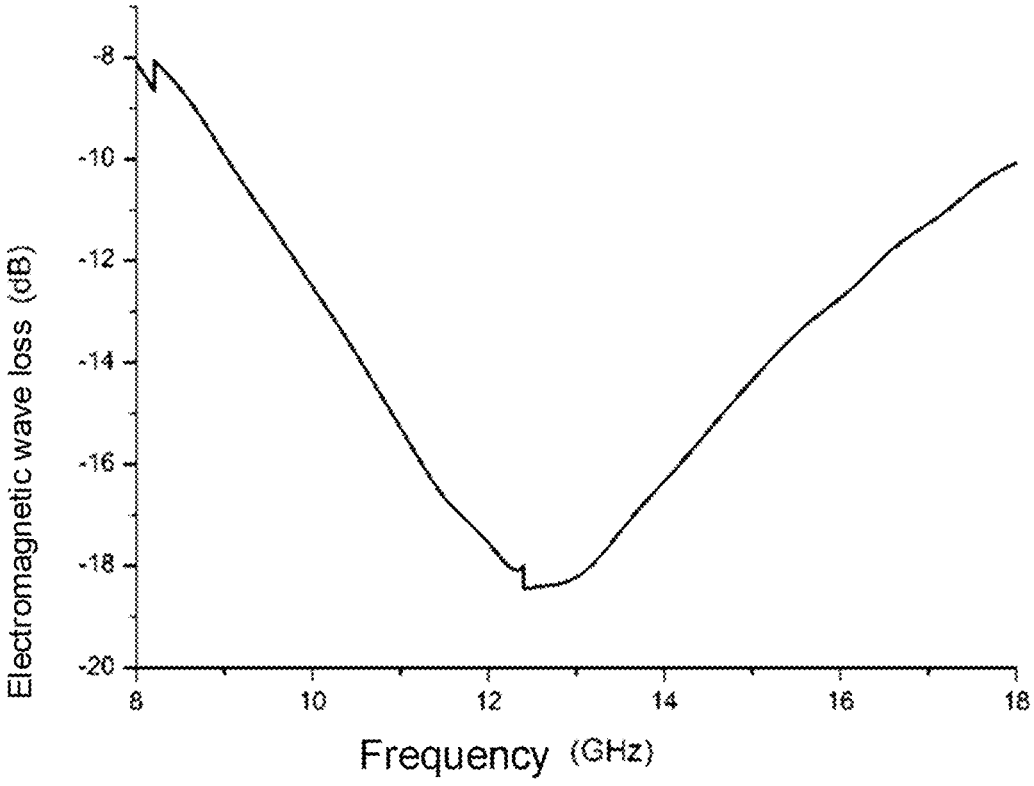
FIG. 7 illustrates a diagram of the electromagnetic wave absorption performance of the fiber material needled felt (with a thickness of 10 mm) prepared in one embodiment of the present disclosure.

After the tests, the fiber materials prepared in this embodiment, whose phase transition enthalpy is up to 99 J/g, and is equipped with ultra-low infrared transmittance in the infrared band ranges from 3 μm to 15 μm. The fibers are needled into the felt and the felt is placed on the back of the human hand, and the thermal imaging detection image of the human hand is as illustrated in FIG. 6. The absorption frequency band of the felt with a thickness of 10 mm that reaches the absorption efficiency below −10 dB in the range from 8 GHz to 18 GHz is 8.7 GHZ, and the electromagnetic wave absorption performance is as illustrated in FIG. 7.

What is claimed is:

1. A method for preparing skin-core structure fibers with both infrared and radar stealth, comprising the following steps:

Step 1), melting in parts by weight 10 parts of paraffin and adding with 0.7 parts to 1.5 parts of an electromagnetic wave absorbent, stirring evenly and thoroughly to obtain molten solution S1, wherein the electromagnetic wave absorbent is a combination of a carbon black and one or more of a ferroferric oxide-intercalated graphene oxide and a nano ferroferric oxide;

Step 2), melting 1 part of a high-molecular polymer, subsequently adding the high-molecular polymer into the molten solution S1, stirring thoroughly and evenly and then drying to obtain a core material S2, wherein the high-molecular polymer is one or more of a polyethylene, a polypropylene and an ethylene-vinyl acetate;

Step 3), dissolving polyacrylonitrile into a N, N-dimethylacetamide, stirring evenly and standing still, to obtain an external phase spinning solution; and Step 4), taking the core material S2 as the core material and taking the external phase spinning solution as a skin material for solution spinning, to obtain the skin-core structure fibers with both infrared and radar stealth.

2. The method for preparing the skin-core structure fibers with both the infrared and the radar stealth according to claim 1, wherein a melting temperature of the paraffin in Step 1) is 70° C.

3. The method for preparing the skin-core structure fibers with both the infrared and the radar stealth according to claim 1, wherein a melting temperature of the high-molecular polymer in Step 2) ranges from 130° C. to 140° C.

4. The method for preparing the skin-core structure fibers with both the infrared and the radar stealth according to claim 1, wherein a standing time in Step 3) is 10 hours.

5. The method for preparing the skin-core structure fibers with both the infrared and the radar stealth according to claim 1, wherein a mass concentration of the polyacrylonitrile in the external phase spinning solution in Step 3) ranges from 20% to 25%.

6. The method for preparing the skin-core structure fibers with both the infrared and the radar stealth according to claim 3, wherein a nozzle temperature of the core material in Step 4) is controlled from 140° C. to 150° C.

7. A method for preparing an infrared stealth material and a radar stealth material, comprising needling the skin-core structure fibers with both infrared and radar stealth prepared by the method according to claim 1 into felt.

* * * * *